United States Patent [19]

Joshi et al.

[11] 4,116,690

[45] Sep. 26, 1978

[54] FLUX FOR USE IN ELECTROSLAG REFINING PROCESS

[75] Inventors: Satish Vishwanath Joshi, Kokomo, Ind.; Douglas Lee Bracher, Downingtown, Pa.

[73] Assignee: Lukens Steel Company, Coatesville, Pa.

[21] Appl. No.: 760,863

[22] Filed: Jan. 21, 1977

[51] Int. Cl.[2] ..... C22B 9/10

[52] U.S. Cl. ..... 75/257; 75/10 R

[58] Field of Search ..... 75/10–12, 75/94, 257

[56] References Cited

U.S. PATENT DOCUMENTS

| | | | |
|---|---|---|---|
| 3,953,579 | 4/1976 | Herchenroeder | 75/10 R |
| 3,980,468 | 9/1976 | Rosof | 75/10 R |

FOREIGN PATENT DOCUMENTS

| | | | |
|---|---|---|---|
| 979,583 | 1/1965 | United Kingdom | 75/10 R |

*Primary Examiner*—P. D. Rosenberg

*Attorney, Agent, or Firm*—Mason, Mason & Albright

[57] ABSTRACT

A flux for use in an electroslag refining system utilizing 5 - 20% of the material bastnasite, a mixed rare-earth, fluocarbonate mineral, with the balance of the flux designed using primarily:

Calcium fluoride ($CaF_2$)

Aluminum Oxide ($Al_2O_3$)

and other fluxing materials based on the specific objectives of the remelting operation, characterized by providing good desulfurization and substantial exclusion of atmospheric hydrogen from the liquid metal pool.

3 Claims, No Drawings

FLUX FOR USE IN ELECTROSLAG REFINING PROCESS

BACKGROUND OF THE INVENTION

The invention relates to a flux composition used in the electroslag refining process. In particular, the invention relates to a flux for such use which substantially precludes introduction of hydrogen into the resulting steel and at the same time maintains good desulfurization capacity.

The electroslag remelting process basically comprises the fusing, from a consumable electrode, of metal, which is refined in and under a blanket of molten flux and solidified in a surrounding mold. Generally this is accomplished by suspending a consumable electrode within the mold with its lower end received in molten flux which was previously introduced, the flux acting as a conductor for electric current passing between the consumable electrode and a base plate or stool at the bottom of the mold. The current passing through the electrode and molten flux causes a rise in temperature of the electrode, and droplets of metal melting off the electrode's lower end fall through the flux to the bottom of the mold, where a pool of molten metal forms and solidification of the metal takes place upwardly from the bottom of the pool. The molten metal undergoes a refining action as it passes through the molten flux and, as the electrode is progressively consumed, a refined metal ingot is formed which builds up from the bottom of the mold. The molten flux floats on the pool of refined metal and is maintained in contact with the lower end of the consumable electrode. The refining process continues until the electrode is substantially or entirely consumed.

For the electroslag refining process, the ideal flux composition should have an appropriate melting point, low vapor pressure, low viscosity, low starting moisture content, high electrical resistivity, capacity to produce good surface quality, capacity to maximize desulfurization, and capacity to prevent excessive oxidation of easily oxidizable alloying elements. Further, the flux should not transport hydrogen from the atmosphere to the liquid metal pool and should not produce unstable operating conditions in the electroslag refining process.

In early work on the flux chemistry, a flux composition which had as principal components, $CaF_2$, $Al_2O_3$ and CaO was employed. Good quality steel ingots were produced by using such chemistry. However, a problem persisted with a potential for the introduction of hydrogen into the remelted ingot. This could be caused by high starting moisture content of the flux and/or the absorption of moisture from surrounding air by the flux, disassociation of moisture into hydrogen and oxygen in the flux, and absorption of hydrogen by the molten steel passing through the flux and before it solidifies under the flux. To meet this problem, a flux having a chemistry of approximately 70% $CaF_2$ and 30% $Al_2O_3$ was utilized. This flux substantially reduced but did not eliminate the hydrogen problem. Secondly, this flux has a reduced desulfurization capacity in the electroslag remelting process as compared with a flux composition, the principal components of which are $CaF_2$, $Al_2O_3$, CaO. Furthermore it reduces the electrical efficiency, deepens the liquid metal pool and is corrosive to refractories employed in melting the slag prior to introducing same to the mold, all of which are undesirable to the process.

SUMMARY OF THE INVENTION

In a search for an improved flux composition for the electroslag refining process, it occurred to the inventors that bastnasite, a mixed rare-earth fluocarbonate mineral, might, if mixed in appropriate amounts with other components, produce a composition which would better meet the requirements of a flux for the electroslag refining process and overcome difficulties of present flux compositions. Several compositions which include bastnasite have been tried with promising results. These compositions fall within the following ranges: 40 - 70% $CaF_2$, 15 - 35% $Al_2O_3$, 5 - 20% bastnasite. In trials with such compositions, it has been found that the flux composition has a satisfactory electrical resistivity, the surface quality of the ingots produced is good, operation of the process is stable, satisfactory desulfurization and deoxidization results and reduction of the harmful effects of hydrogen is achieved.

DESCRIPTION OF THE PREFERRED EMBODIMENTS

The invention is directed to a flux for use in an electroslag refining process which adequately meets the necessary characteristics as set forth above. Each flux composition for the electroslag refining process covered by the invention utilizes bastnasite, a mixed rare-earth fluocarbonate mineral, as an ingredient.

Tests were undertaken on compositions having the following ingredients, by percentage:

| $CaF_2$ | $Al_2O_3$ | Bastnasite |
|---|---|---|
| 70 | 20 | 10 |
| 65 | 25 | 10 |
| 60 | 30 | 10 |

Laboratory experiments of the compositions set forth above indicate that these fluxes are satisfactory from the standpoint of melting point, low vapor pressure, low viscosity and low starting moisture content. In addition, electrical resistivity, surface quality, operational stability, desulfurization and deoxidation characteristics are all within desired operable limits. Moreover, the detrimental effects of hydrogen are controlled. The above percentages may be modified within about a 10% plus to 5% minus range without undue loss of the advantages incident to the invention. For particular applications the $CaF_2$ may be as low as 40%.

A further flux composition: 67% $CaF_2$, 22% $Al_2O_3$ and 11% bastnasite, was given a mill trial in the month of August which, for the area involved (Southern Pennsylvania) is generally a humid month. The metal chemistry of the electrode was, in percentages, as follows: carbon — 0.25; manganese — 0.92; phosphorus — 0.01; sulfur — 0.017; copper — 0.15; nickel — 0.09; chromium — 1.06; molybdenum — 0.55; silicon — 0.32; vanadium — 0.08; and the balance iron and incidental impurities. In producing an ingot in a mold size of 60 inches × 20 inches, electrical power consumption was reduced by 10% as compared to 70% $CaF_2$ _ 30% $Al_2O_3$ flux composition.A 72% desulfurization was obtained as compared to a 50% desulfurization for 70% $CaF_2$_30% $Al_2O_3$ flux composition. The surface quality was excellent and the viscosity of the flux was markedly less than the 70% $CaF_2$ _ 30% $Al_2O_3$ flux composition. The detrimental effects of hydrogen were controlled. The resulting ingot had a composition in percentages as follows: 0.23 carbon; 0.89 manganese; 0.01 phosphorus; 0.0047 sulfur; 0.14 copper; 0.09 nickel; 1.02 chromium; 0.55 molybdenum; 0.31 silicon; 0.03 aluminum; 0.08 vanadium and the balance iron and incidental impurities.

The trial clearly demonstrated the advantages of using bastnasite as a flux ingredient in the electroslag remelting process; the flux provided satisfactory protection from hydrogen, gave good surface quality, good desulfurizaton, fluidity and improved electrical efficiency.

Additional fluxing material may be desirable for certain applications. For example, an additional fluxing material was employed in an Inconel 600 remelt. Five percent (fifty pounds) of titanium oxide ($TiO_2$) was added to the flux system to protect from oxidation titanium present in the Inconel 600. The advantages of using bastnasite as a flux ingredient were obtained, and chemical analysis of the remelted ingot showed that the addition of the titanium oxide thoroughly protected the titanium present in the Inconel 600.

In the claims and the specification, percentages and fractions, unless otherwise indicated, are by weight.

Although the preferred embodiments of our invention are described above, it should be understood that it is capable of other adaptations and modifications within the scope of the appended claims.

Having thus described our invention, what we claim as new and desire to secure by Letters Patent of the United States is:

1. A flux used in an electroslag refining process which provides good desulfuration and substantially precludes the introduction of hydrogen into the liquid metal pool, the flux containing:

40 – 70% Calcium Fluoride ($CaF_2$),
15 – 35% Aluminum Oxide ($Al_2O_3$),
5 – 20% Bastnasite, a mixed rare-earth fluocarbonate mineral.

2. A flux in accordance with claim 1, including further fluxing materials based on the specific objectives of the remelting operation.

3. A flux in accordance with claim 2, wherein the further fluxing material comprises $TiO_2$.

* * * * *